United States Patent [19]

Huber

[11] 3,972,631

[45] Aug. 3, 1976

[54] ADHESIVE APPLICATOR

[75] Inventor: Raymond B. Huber, Willow Street, Pa.

[73] Assignee: Armstrong Cork Company, Lancaster, Pa.

[22] Filed: June 11, 1975

[21] Appl. No.: 585,801

[52] U.S. Cl. ..... 401/261; 401/265

[51] Int. Cl.[2] ..... A47L 13/30

[58] Field of Search ..... 401/261, 266, 171–186, 401/132, 2, 265; 222/289, 191

[56] References Cited

UNITED STATES PATENTS

| | | | |
|---|---|---|---|
| 1,312,347 | 8/1919 | Ogden | 401/2 |
| 2,376,243 | 5/1945 | Fraser | 401/261 X |
| 2,711,098 | 6/1955 | Ames | 401/171 X |
| 3,334,792 | 8/1967 | De Vries et al. | 401/266 X |

*Primary Examiner*—Lawrence Charles

[57] ABSTRACT

An applicator adapted to be mounted on a hand-operated container to spread an adhesive film of predetermined uniform width and thickness onto a working surface. The applicator comprises a non-flexible body having an open bottom adhesive receiving chamber. The applicator is adapted to be mounted on a container by an attaching means provided with an opening which is in communication with the receiving chamber to allow adhesive to be fed from the container into the chamber and onto the working surface therebeneath. A single material-metering outlet extending from the receiving chamber to the front edge of the body is provided to meter the width and thickness of a film of adhesive applied to the working surface with a backward movement of the applicator.

5 Claims, 5 Drawing Figures

ADHESIVE APPLICATOR

BACKGROUND OF THE INVENTION

1. Field of the Invention

This invention relates generally to an adhesive applicator and more particularly to an adhesive applicator adapted to be mounted on a hand-operated container and used to apply a film of adhesive of uniform width and thickness onto a working surface for the installation of floor covering.

2. Description of the Prior Art

U.S. Pat. No. 1,625,863 relates to an apparatus for applying a viscous material to floor coverings. The apparatus comprises a container having a plurality of openings in the bottom wall thereof which extend into the side wall to provide discharge openings therein. The body of the viscous material in the distributing head exerts its pressure on the material passing through the slats and into the interstices of the floor covering. Strips of the material are formed on the floor covering by material issuing from the side wall openings of the device as it is moved across the floor.

U.S. Pat. No. 2,804,767 relates to a gun-type trowel for spreading finishing material such as plaster, mortar, cement and the like on wall surfaces. The trowel has a resilient blade and a corrugated flexible duct structure on the underside thereof. The duct structure and the trowel blade are integral with an adapter for attaching the device to a caulking gun.

U.S. Pat. No. 2,943,338 relates to a container closure and applicator adapted for use with a bottle, tube, or the like, wherein the container serves as a handle for wielding the spreading means. The closure and applicator of this invention replaces the original closure supplied on the container and is used to spread adhesive or the like after it has been deposited on a working surface prior to application of the closure-applicator to the container. A modification of the spreader includes a bead along each longitudinal edge of the spreader for applying a uniformly thick band of adhesive to a working surface.

In the past, floor surface coverings, particularly those of the type having a foam backing layer, have been installed on a floor by first applying an adhesive to the floor in the areas where the borders and seams of the floor covering were to be located, to hold it in place. It was previously recognized that the adhesive should not only secure the covering to the floor, but should also permit the covering to be removed therefrom for replacement, moving to another residence, etc., without leaving portions of the adhesive adhered to the floor and, in some cases, with portions of the foam backing attached thereto. It was apparent that a film of adhesive of a constant predetermined width, and of proper uniform thickness which would require a minimum drying time, would still hold the covering to the floor, and which could be removed therefrom without leaving portions of the adhesive remaining on the floor was desirable. To apply such a film, a variety of applicators have been tried. The prior art applicator and/or applicator-closure structures, however, have been undesirably complicated in design and have required tedious and careful manipulation in use in order to achieve an approximation of the desired results therefrom. This, of course, has resulted in increased costs, less than satisfactory results, and rendered them difficult to use. It has been desired in the past to provide an applicator structure which would be compact in overall size, could be used without removal from the material-supply container, could be held in one hand for use, and which would assure the formation of a film of adhesive of uniform width and thickness on a working surface without any special manipulation of the applicator being required to achieve the desired non-varying results.

SUMMARY OF THE INVENTION

This invention relates to an adhesive applicator adapted to be mounted on and used simultaneously with a hand-operated adhesive container such as a squeeze bottle, metal can, or the like, wherein the adhesive container serves as a handle for the applicator and adhesive is deposited onto the working surface beneath an adhesive receiving chamber in the applicator through an opening in the means for attaching the applicator to the container. The adhesive is then spread onto the working surface in a film of uniform thickness by a backward movement of the applicator thereover. The material-receiving chamber has side walls, the bottom edges of which terminate in a single plane so that they contact the working surface when the applicator is in use. A front wall extends downwardly from the top portion of the material-receiving chamber and has a bottom edge which terminates in spaced relation to a working surface when the bottom edges of the side walls are in contact therewith. Thus, a material metering outlet is provided for the material receiving chamber. The metering outlet is about 10 to 12 mils in height and about 2 inches in width, thus a film having a width to thickness ratio preferably of about 200 to 1 is formed when the applicator is in use. It has been found that this is the optimum width and thickness for an adhesive film for use, for example, in the installation of foam-backed floor covering. If a thicker film is used, an excessive drying time is required therefor. A thinner film lacks the body to allow removal thereof without tearing. Thus, it can readily be seen why constant uniformity of the film thickness is important. A width to thickness ratio of at least about 100 to 1 accomplishes these objectives.

By this invention, the problems of the prior art are solved through the provision of a substantially rigid adhesive applicator which requires no extensive manipulation in use to achieve desired results. The applicator is simpler and more compact in design than the prior art structures, is more durable, assures uniformity of thickness and width of an adhesive film being deposited on a working surface, the simple design reduces costs, makes it easy to use, and holds overall size to a minimum without sacrificing and really assuring improved results.

DESCRIPTION OF THE PREFERRED EMBODIMENT

Figure 1:
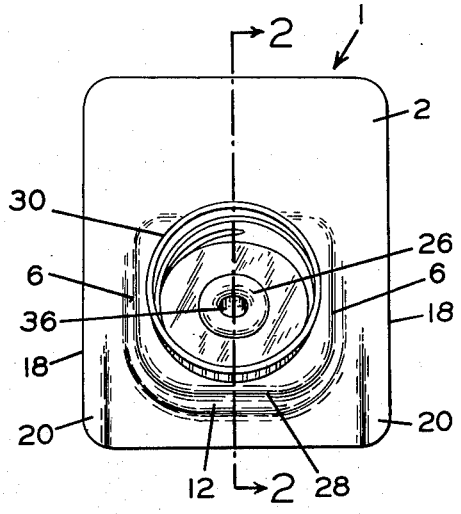
FIG. 1 is a top plan view of the preferred structural form of the adhesive applicator of this invention.
Figure 2:
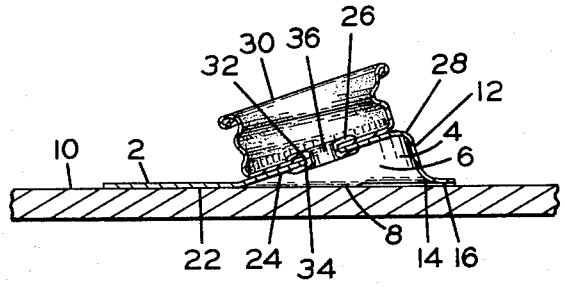
FIG. 2 is a side elevational view of a section taken along line 2—2 of FIG. 1 of the adhesive applicator and shown in position on a working surface.
Figure 3:
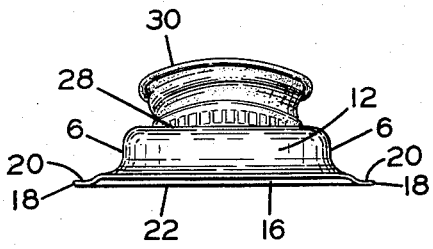
FIG. 3 is a front elevational view of the adhesive applicator of FIG. 1.

As shown in FIGS. 1, 2, and 3 of the drawings, the preferred embodiment of the applicator structure 1 comprises a normally flat rectangularly-shaped metal plate 2 which is formed to include a substantially wedge-shaped material-receiving chamber 4 which is preferably located centrally with respect to the width of the plate 2 and forwardly with respect to the center of the longitudinal dimension thereof. The receiving chamber 4 has side wall 6, the bottom edges 8 of which terminate in a single plane and are in contact with a working surface 10 when the applicator is being used. The receiving chamber 4 also has a front wall 12 which extends downwardly at an angle to the plane of the flat body portion of the plate 2. The bottom edge 14 of the front wall 12 of the receiving chamber 4 is slightly elevated above the plane of termination of the bottom edges 8 of the side wall 6 thereby forming a material metering outlet 16 for the receiving chamber 4. As shown, the receiving chamber 4 and the outlet opening 16 extend incompletely across the width of the applicator body 1 and terminate in spaced relation to the side edges 18 of the plate 2 leaving edge portions 20 which are in reality side edge continuations of the plate 2. The top wall 24 of the wedge-shaped receiving chamber 4 slopes downwardly and rearwardly from the top edge 28 of the front wall 12 of the chamber. A container closure 30 is mounted on the top surface of the sloping top wall 24 by means of a grommet or eyelet 26 secured through communicating openings 32 and 34 in the closure 30 and the top wall 24 of the receiving chamber 4. Thus, an opening 36 is provided to enable fluid material to pass from an appropriate supply container (not shown) onto the working surface 10 in the area beneath the material receiving chamber 4 when the applicator is in use.

In use, the closure 30 is mounted on a squeeze bottle or the like (not shown), the bottom surface 22 of the plate 2 is placed on a working surface 10, and a commodity such as an adhesive is forced from the container through the opening 36 onto the working surface 10 in the area beneath the material-receiving chamber 4. Further, in use, the substantially wedge-shaped receiving chamber 4 coacts with the working surface 10 therebeneath to serve as a reservoir for the adhesive to be applied to the surface 10 in the form of a film by means of the metering outlet 16. As the applicator is drawn backwardly over the working surface 10, a rolling bank of adhesive is formed behind the front wall 12 of the chamber 4 and a 10–12 mil film of adhesive is spread on the working surface as indicated above. The thickness and the width of the film is, of course, controlled by the dimensions of the metering outlet 16.

Figure 5:
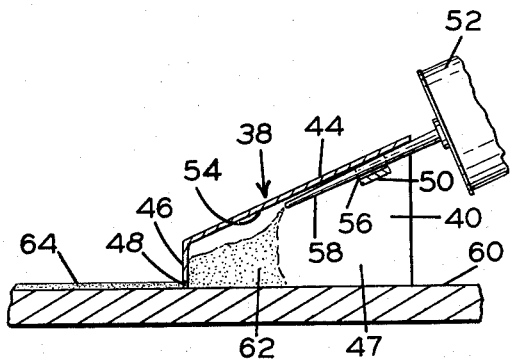
FIG. 5 is a sectional view of the applicator of FIG. 4 mounted on a broken-away portion of a material supply container.
Figure 4:
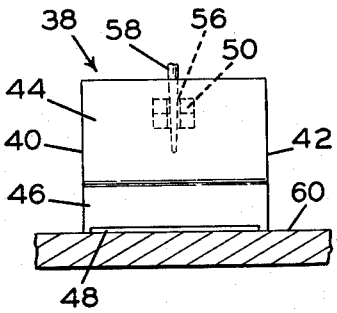
FIG. 4 is a front elevational view of a modified form of the adhesive applicator embodying the concept of this invention and adapted to be used with a material supply container (not shown) having a long spout and shown positioned for use on a working surface.

A modified form of an adhesive applicator embodying the concept of this invention is shown in FIGS. 4 and 5 of the drawings. This form of the applicator is simplified and adapted to be used in conjunction with a material-supply container having an elongated spout. As shown in the drawings, this form of the applicator comprises a body 38 having side walls 40 and 42, a downwardly inclined top wall 44, and a front wall 46 which form a material-receiving chamber 47. As shown in the drawings, the bottom edge of the front wall 46 includes a metering outlet 48. Means 50 for attaching the applicator body 38 to a material-supply container 52 is provided on the underside 54 of the inclined top wall 44 in the material-receiving chamber 47. Attaching means 50 is provided with a longitudinal opening 56 therethrough which is adapted to receive an elongated spout, such as shown at 58, of a material-supply container 52. In use, the applicator 38 is mounted on a material-supply container such as shown at 52 by inserting the elongated spout 58 thereof through the opening 56 in attaching means 50. The applicator 38 is then placed on a working surface 60 and adhesive 62 supplied from the container 52 through spout 58 is deposited on the working surface 60 in the area covered by the material-receiving chamber 47. The applicator 38 and container 52 are then moved along the working surface 60 with a backward movement causing a bank of the adhesive 62 to form behind the front wall 46 and be metered through the metering outlet 48 of the applicator 38 to apply a film of adhesive 64 of uniform width and thickness onto the working surface 60.

It can thus be seen that the device of this invention provides an applicator for adhesive or the like adapted for use with a squeeze bottle, a tube, a can or similar container, which increases the utility of the container in that the container serves as a handle for wielding the applicator. It can be further seen that it is not necessary to remove the applicator from the container for use, but may be used simultaneously with the discharge of the adhesive therefrom onto a working surface. It can be further seen that this applicator allows rapid, yet accurate and uniformly thin adhesive films, to be deposited on a working surface with a minimum of effort. This is achieved by the novel structure of the applicator which allows a suitable amount of the commodity to be deposited on a working surface in the area beneath the material-receiving chamber and then, due to the metering outlet provided across a portion of the width of the front bottom surface of the applicator, a metering of an adhesive film of predetermined uniform thickness and width onto the working surface is achieved. Since the spreader or applicator is made of rigid metal and has a large floor-contacting bottom surface, it will not flex or bend to cause variations in the uniformity of the thickness of the film being applied thereby. Additionally, the need for manipulation of the applicator such as tilting, and/or increasing or decreasing pressure thereon to obtain a desired film thickness, is eliminated. Obviously, with the present invention, it is unnecessary for the adhesive to come in contact with the fingers or clothes of the person using the same, thereby eliminating one of the most undesirable features of working with this or similar sticky substances.

What is claimed is:

1. An applicator adapted to be mounted on a material-supply container for spreading upon a working surface, with a drawing action, a uniform film of a heavy consistency fluid material issuing from the container, said applicator comprising a two-piece structure having no movable parts and including:

a. a rigid main body portion comprising a single piece of normally flat sheet metal having a top surface and a bottom surface, said body portion including a completely open bottom material-receiving chamber formed therein and extending upwardly from the bottom surface of the sheet, said material-receiving chamber having side walls, the bottom edges of which terminate in a single plane so that they contact the surface receiving the material from the supply container when the applicator is in use, said receiving chamber also having a front wall with a bottom edge at least a portion of which terminates in spaced relation to a material-receiving surface when the bottom edges of the side walls are in contact therewith to provide a single material-metering outlet in the applicator; and b. means on said body portion for attachment of the applicator to an appropriate material-supply container, said attaching means adapted to permit the flow of said fluid material from said container into said receiving chamber.

2. An applicator according to claim 1, wherein the material-receiving chamber has an inclined top wall portion and the means for attaching the applicator to a material-supply container is mounted thereon.

3. An applicator according to claim 2, wherein the means for attaching the applicator to a material-supply container is mounted on the outer surface of the inclined top wall portion of the material-receiving chamber.

4. An applicator according to claim 3 wherein the body portion comprises a normally flat metal plate having a top surface and a bottom surface, the material-receiving chamber comprises a generally wedge-shaped cavity extending upwardly from the bottom surface of the plate, the top wall of the cavity being inclined downwardly and rearwardly from the top of the front wall thereof, the means for attaching the applicator to a material-supply container comprises a container closure mounted on the outer surface of the inclined top wall of the material-receiving chamber, said closure having a centrally located opening through the top thereof in communication with an opening in the top wall of the material-receiving chamber to permit the flow of the material from the container into the receiving chamber, the means for fastening the container closure on the applicator is positioned in the communicating openings in the closure and the inclined top wall of the material-receiving chamber, and wherein the material-metering outlet extends incompletely across the width of the applicator and has a height of from about 10 to 12 mils.

5. An applicator adapted to be mounted on a material-supply container for spreading upon a working surface, with a drawing action, a uniform film of a heavy consistency fluid material issuing from the container, said applicator comprising:

a. a body portion comprising a normally flat, rectangularly shaped metal plate;

b. a substantially wedge-shaped material-receiving chamber formed in said body portion, said receiving chamber being located centrally with respect to the width of the applicator and forwardly with respect to the center of the longitudinal dimension thereof, said receiving chamber having side walls, the bottom edges of which terminate in a single plane so that they contact the surface receiving the material from the supply container when the applicator is in use, said receiving chamber also having a front wall disposed at an angle with respect to the plane of termination of the bottom edges of the side walls, said front wall having a bottom edge which terminates in spaced relation in the amount of 10–12 mils to a material-receiving surface when the bottom edges of the chamber's side walls are in contact therewith to provide a single material-metering outlet in the applicator, said metering outlet including a top wall extending forwardly from the bottom edge of the front wall of the material-receiving chamber to the front edge of said applicator body and incompletely across the width of said applicator body and terminating in spaced relation to the side edges thereof, said receiving chamber also extending incompletely across the width of the applicator and terminating in spaced relation to the sides thereof, said receiving chamber further having a top wall which is inclined rearwardly and downwardly from the top of the front wall of the receiving chamber;

c. a container closure mounted on the outer surface of the rearwardly and downwardly inclined top wall portion of the material-receiving chamber, said closure having a centrally located opening through the top thereof in communication with an opening in said top wall portion of the receiving chamber; and d. a fastener positioned in the communicating openings in the container closure and the top wall of the material-receiving chamber to secure the closure and the applicator to each other, said fastener having an opening therethrough to enable said fluid material to pass from the supply container onto the surface receiving the material in the area beneath the material-receiving chamber when the applicator is in use whereby, upon backward movement of the applicator, a uniform film of the material is applied onto the surface.

* * * * *